US006794979B2

(12) United States Patent
Sudan et al.

(10) Patent No.: US 6,794,979 B2
(45) Date of Patent: Sep. 21, 2004

(54) FUSE HOLDER ASSEMBLY

(75) Inventors: Madhu Sudan, Bangalore (IN); Javier Gomez Martin, Madrid (ES); Jorge Vallejo, Madrid (ES); Anilkumar Dinker Pandit, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/063,474

(22) Filed: Apr. 26, 2002

(65) Prior Publication Data

US 2003/0201866 A1 Oct. 30, 2003

(51) Int. Cl.[7] ..... H01H 85/20; H01H 85/22

(52) U.S. Cl. ..... 337/211; 337/284; 337/208; 337/209

(58) Field of Search ..... 337/186–189, 337/208–211, 283, 284; 29/623

(56) References Cited

U.S. PATENT DOCUMENTS 3,030,474 A * 4/1962 Scott, Jr. ..... 337/7
3,202,788 A * 8/1965 George ..... 337/194
3,358,100 A * 12/1967 Schleicher et al. ..... 337/194
3,379,842 A * 4/1968 Downs et al. ..... 337/146
3,432,789 A * 3/1969 Poehlman, Jr. ..... 337/242
3,732,516 A * 5/1973 Puetz ..... 337/194
4,149,216 A * 4/1979 Kussy et al. ..... 361/642
4,178,061 A * 12/1979 Ahroni ..... 439/622
4,559,504 A * 12/1985 Krec ..... 337/194
5,076,118 A * 12/1991 Lawson ..... 81/3.8
D346,791 S * 5/1994 Marach et al. ..... D13/160
5,355,274 A * 10/1994 Marach et al. ..... 361/104
D367,041 S * 2/1996 Alfaro et al. ..... D13/160
5,559,662 A * 9/1996 Happ et al. ..... 361/104
5,616,054 A * 4/1997 Quinlan ..... 439/621
5,963,411 A * 10/1999 Mollet et al. ..... 361/104
5,969,587 A * 10/1999 Combas ..... 335/132
5,973,418 A * 10/1999 Ciesielka et al. ..... 307/130
6,459,353 B1 * 10/2002 Mattlar et al. ..... 337/9

* cited by examiner

*Primary Examiner*—Anatoly Vortman
(74) *Attorney, Agent, or Firm*—Cantor Colburn LLP

(57) ABSTRACT

A fuse holder and method of building the same, the fuse holder comprising: a fuse having a pair of fuse terminals; a housing configured to accept any fuse carrier selected from a plurality of fuse carriers, the housing defining an enclosed region adapted to accept the fuse; a pair of contacts within the housing at opposite ends of the enclosed region and configured to engage the fuse terminals; and a fuse carrier selected from the plurality of fuse carriers, the fuse carrier configured to support the fuse and position the fuse terminals in the enclosed region in electrical engagement with the pair of contacts.

19 Claims, 8 Drawing Sheets

FIG. 3
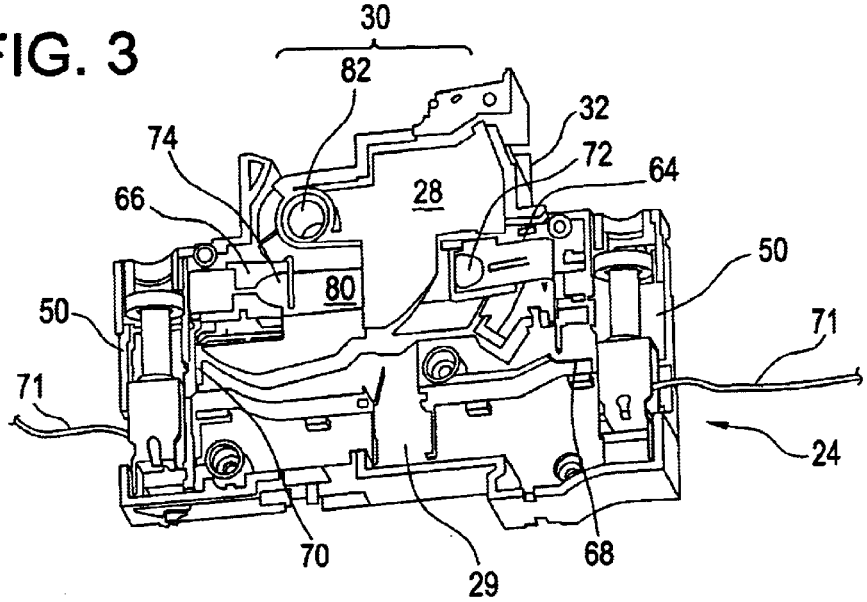
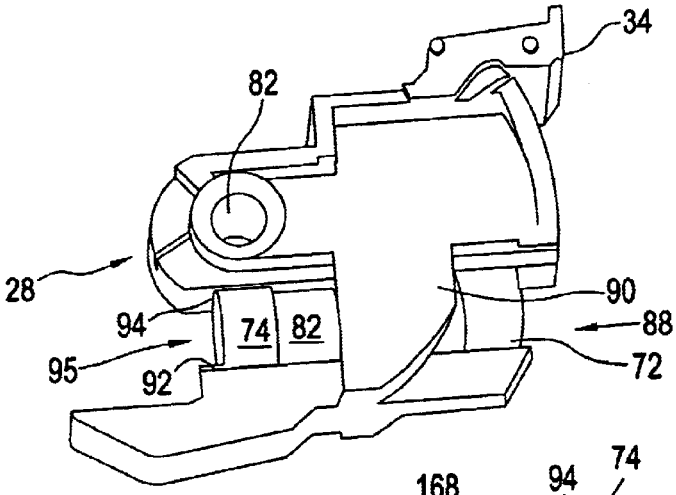
FIG. 4
FIG. 5
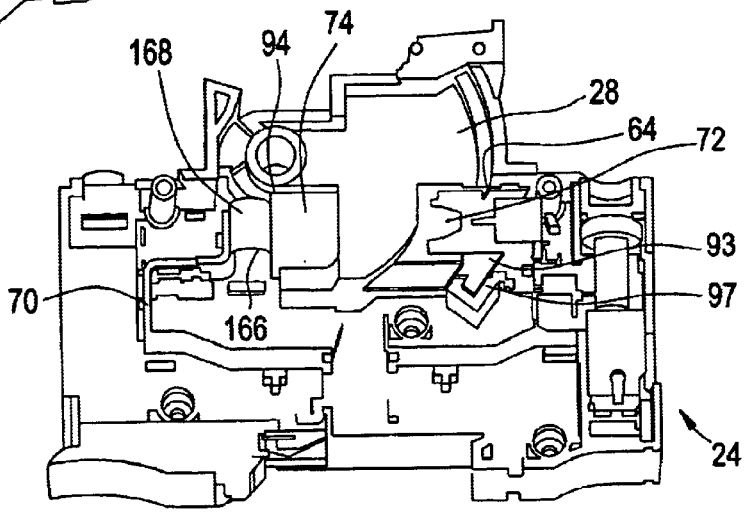

FIG. 10

204 202 206 208 214 216 218 220

| Carrier Type | Fuse Type | Amp | Fuse Length (mm) | Fuse Dia. (mm) | Fuse Cap Length (mm) |
|---|---|---|---|---|---|
| 1 | NFC | 10 | 23 +0-0.8 | 8.5 +-0.1 | 5 +0.2-0.6 |
| 2 | NFC | 15 | 25.8 +-0.4 | 10.3 +-0.1 | 6.3 +-0.4 |
| | BS | 15/20 | 26 +-0.2-0.6 | 10.32 +-0.1 | 6.4 +-0.5 |
| 3 | NFC | 20 | 31.5 +-0.5 | 8.5 +-0.1 | 6.3 +-0.4 |
| 4 | NFC | 25 | 31.5 +-0.5 | 10.3 +-0.1 | 6.3 +-0.4 |
| 5 | NFC | 32 | 38 +-0.6 | 10.3 +-0.1 | 10 +0.5-0.3 |
| 6 | BS | 30 | 29 +-0.4 | 12.7 +-0.1 | 8 +-0.5 |

210

212

200

FUSE HOLDER ASSEMBLY

BACKGROUND OF INVENTION

A fuse holder includes a fuse carrier or fuse-carrier unit mounted within a receptacle or receptacle unit. In use, a fuse carrier bears an elongated fuse which has a pair of terminals. The fuse carrier releasably disposes the terminals for each fuse in tight electrical engagement with companion contacts of the receptacle.

The fuse carrier commonly comprises a body of molded insulation and the receptacle has a base and a complementary cover, both of molded insulation. In use, fuse receptacles are fixed in place, as on a panel. The fuse carrier is pivotally joined to the receptacle.

The pivotally joined carrier incorporates manual force-multiplied means for driving the fuse-carrier outward for releasing the tight grip of the contacts disposed within the receptacle on the fuse terminals. More specifically, the force-multiplying means in the described fuse holder is a lever pivotally disposed at one end of the fuse holder and acting against the other end of the fuse holder. The fuse terminals are forcibly released generally concurrently from the receptacle contacts. Once the carrier is pivoted outward, the fuse may be removed and replaced. Typically, each fuse holder contains one fuse, being a single-pole device for interrupting a single current path. A common form of circuit connection to the receptacle contacts of a fuse holder is by wires that enter the receptacle, joined to the receptacle contacts by screw-actuated wire fasteners.

Presently, different current rated fuses have different diameters and lengths necessitating varying fuse carriers, thus requiring variably configured fuse carriers for each different fuse. In addition, the variably configured fuse carriers necessitate variably configured housings for each different fuse carrier. Thus, the costs associated with tooling, manufacture and inventory of different housings for different fuse carriers is increased.

SUMMARY OF INVENTION

The above discussed and other drawbacks and deficiencies are overcome or alleviated by a fuse holder comprising: a fuse having a pair of fuse terminals; a housing configured to accept any fuse carrier selected from a plurality of fuse carriers, the housing defining an enclosed region adapted to accept the fuse; a pair of contacts within the housing at opposite ends of the enclosed region and configured to engage the fuse terminals; and a fuse carrier selected from the plurality of fuse carriers, the fuse carrier configured to support the fuse and position the fuse terminals in the enclosed region in electrical engagement with the pair of contacts.

In an alternative embodiment, a method of assembling a fuse holder comprising a housing having a cavity therein for supporting a fuse carrier is also disclosed, the method comprising: selecting a fuse carrier from a plurality of fuse carriers, each fuse carrier of the plurality of fuse carriers configured to support a different fuse size, the selecting being based on a desired current rating for a fuse to be fitted within the housing; configuring the fuse carrier to accept and position the fuse for engagement with contacts disposed within the housing; configuring the cavity to accept the plurality of fuse carriers; and installing the selected fuse carrier in the housing.

BRIEF DESCRIPTION OF DRAWINGS

Referring now to the drawings wherein like elements are numbered alike in the several Figures:

FIG. 3 is a perspective view of the fuse holder of FIG. 1 without a cover;

FIG. 4 is a perspective view of a fuse carrier and fuse removed from a fuse holder;

FIG. 5 is a perspective view of the fuse holder in FIG. 3 having a different fuse carrier configured with a shorter fuse;

FIG. 10 is a table listing the fuse carrier types and corresponding fuse for each fuse carrier type;

DETAILED DESCRIPTION

Figure 1:
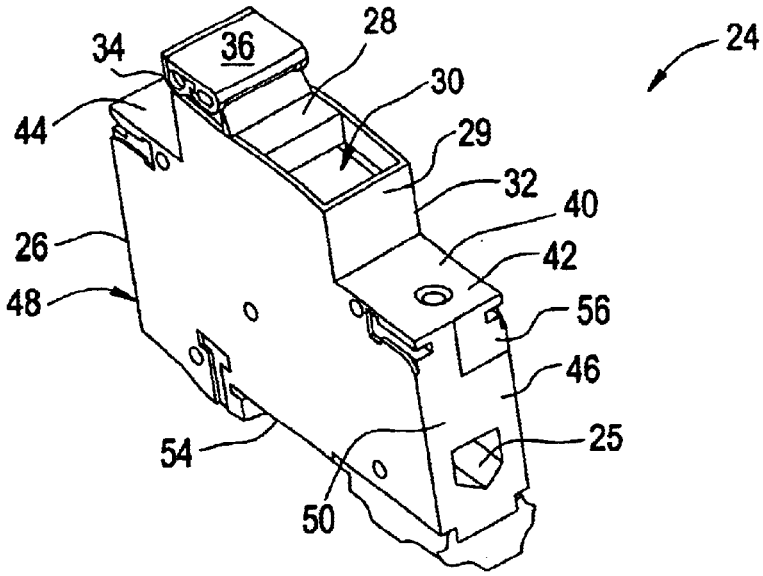
FIG. 1 is a perspective view of an assembled single pole fuse holder.
Figure 2:
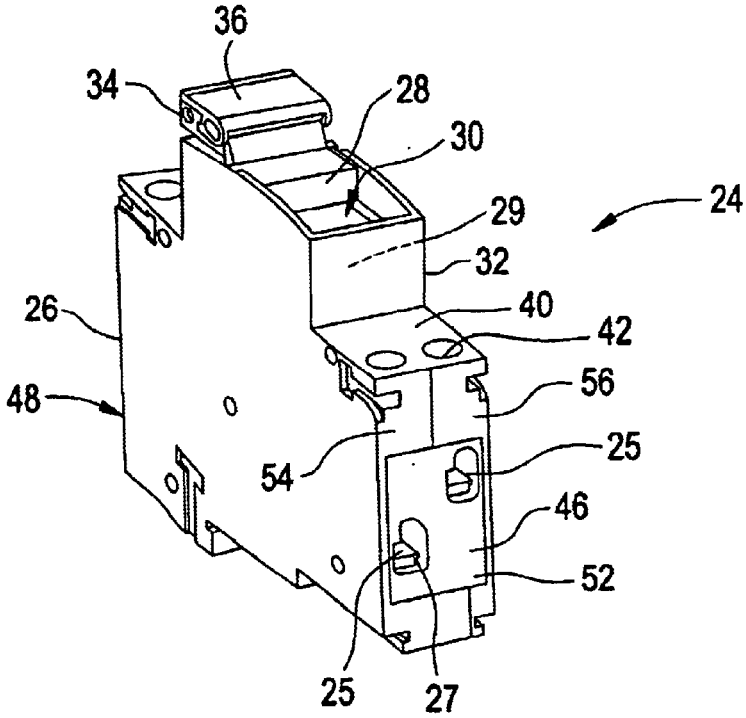
FIG. 2 is a perspective view of an assembled single pole fuse holder having a neutral connector.

Referring to FIGS. 1 and 2, there is shown a fuse holder 24 including a housing 26 and a fuse carrier 28. Housing 26 includes a base 54 and a cover 56 that are adapted to retain a single pole cage holder 50 (FIG. 1) or a two-pole cage holder 52 (FIG. 2). In FIG. 1, housing 26 retains a cage holder 50 that has a single terminal 25 for accepting a wire (not shown) from a phase of a power distribution circuit (not shown). FIG. 2 depicts housing 26 retaining a cage holder 52 having a phase terminal 25 and a neutral terminal 27. Terminal 25 accepts a wire (not shown) from a phase of a power distribution circuit (not shown) and the terminal 27 accepts a neutral wire from the power distribution circuit.

Base 54 and cover 56 of housing 26 define an enclosed region 29 therebetween and an opening 30 to region 29 in a side extension 32 of housing 26. Fuse carrier 28 is pivotally mounted on housing 26 and is movable between a closed position (shown in FIGS. 1 and 2), and an open position (FIG. 9), in which a fuse can be inserted into carrier 28. Fuse carrier 28 includes a lever 34 for pivotally opening and closing carrier 28 relative to housing 26. A circuit indicator tag 36 is optionally disposed on lever 34 to identify the fuse rating of a fuse enclosed within housing 26. On a top surface 40 of housing 26 are two apertures 42, 44 which allow a portion of cage holder 50, or 52 to extend therethrough. Housing 26 also includes a first opening 46 and a second opening 48 disposed at opposite ends of fuse holder 24 and extending in planes generally perpendicularly oriented relative to top surface 40. A portion of cage holder 50 or 52 extends through first and second openings 46 and 48.

Referring to FIG. 3, fuse holder 24 is shown absent cover 56. Within enclosed region 29 of housing 26 are a pair of U-shaped contacts 64, 66 at opposite ends of the enclosed region 29 and spaced to engage end cap terminals 72, 74 on the ends of a fuse 80 when fuse 80 is moved within enclosed region 29. Fuse carrier 28 is pivotally mounted on housing 26 via a pin (not shown) extending through an aperture 82 formed in fuse carrier 28. Fuse carrier 28 is movable between a closed position (shown in FIG. 3), in which contacts 64, 66 electrically engage end cap terminals 72, 74. Contacts 64, 66 are connected to terminals 68, 70, respectively. Terminals 68, 70 are in turn received within cage holders 50 and are in electrical communication with electrical wires 71, which are also received within cage holders 50.

Referring to FIG. 4, fuse carrier 28 defines fuse insertion region 88. Fuse carrier 28 further includes an aperture 90 configured to slidably receive end cap terminal 74 when fuse 80 is inserted in fuse insertion region 88. Fuse carrier 28 has shoulders 92, 94 at the lower end of region 88 to prevent further translation of fuse 80 through aperture 90. The outside diameter of end cap terminal 74 rests against shoulders 92, 94. As is best shown with reference to FIGS. 3 and 4, end cap terminal 72 fits within the other end of fuse insertion region 88 to allow fuse carrier 28 to pivot to a closed position without having end cap terminal 72 contacting side extension 32 that forms opening 30 (FIG. 3). Opening 30 to housing 26 is sized to permit closure of carrier 28 with fuse 80 carried therein.

Referring to FIG. 5, fuse holder 24 shown in FIG. 3 includes an alternative fuse carrier 28 for holding a shorter fuse 80. Shoulder 94 is disposed on fuse carrier 28 such that when fuse carrier 28 is in the closed position, terminal 64 is aligned with end cap terminal 72 of fuse 80. Since fuse 80 is shorter in FIG. 5 than in FIG. 3, terminal 66 of FIG. 3 is not long enough to electrically connect to end cap terminal 74 of shorter fuse 80. An alternative contact 166 is used to make an electrical connection with end cap terminal 74. Contact 166 is generally C-shaped, and electrical contact is made between an outside surface 168 defining the C shape, end cap terminal 74, and terminal 70. Shoulder 94 prevents further translation of fuse 80 to the left. An end stop 93 disposed in a recess 97 formed in base 54 to receive end stop 93 prevents a bias of contact 166 from translating fuse 80 to the right as shown in FIG. 5. End stop 93 also guides fuse 80 into electrical communication with contacts 64, 66, 166 by positioning fuse 80 intermediate contacts 64, 66, 166 as fuse carrier 28 and fuse 80 are pivotally moved into enclosed region 29.

Figure 6:
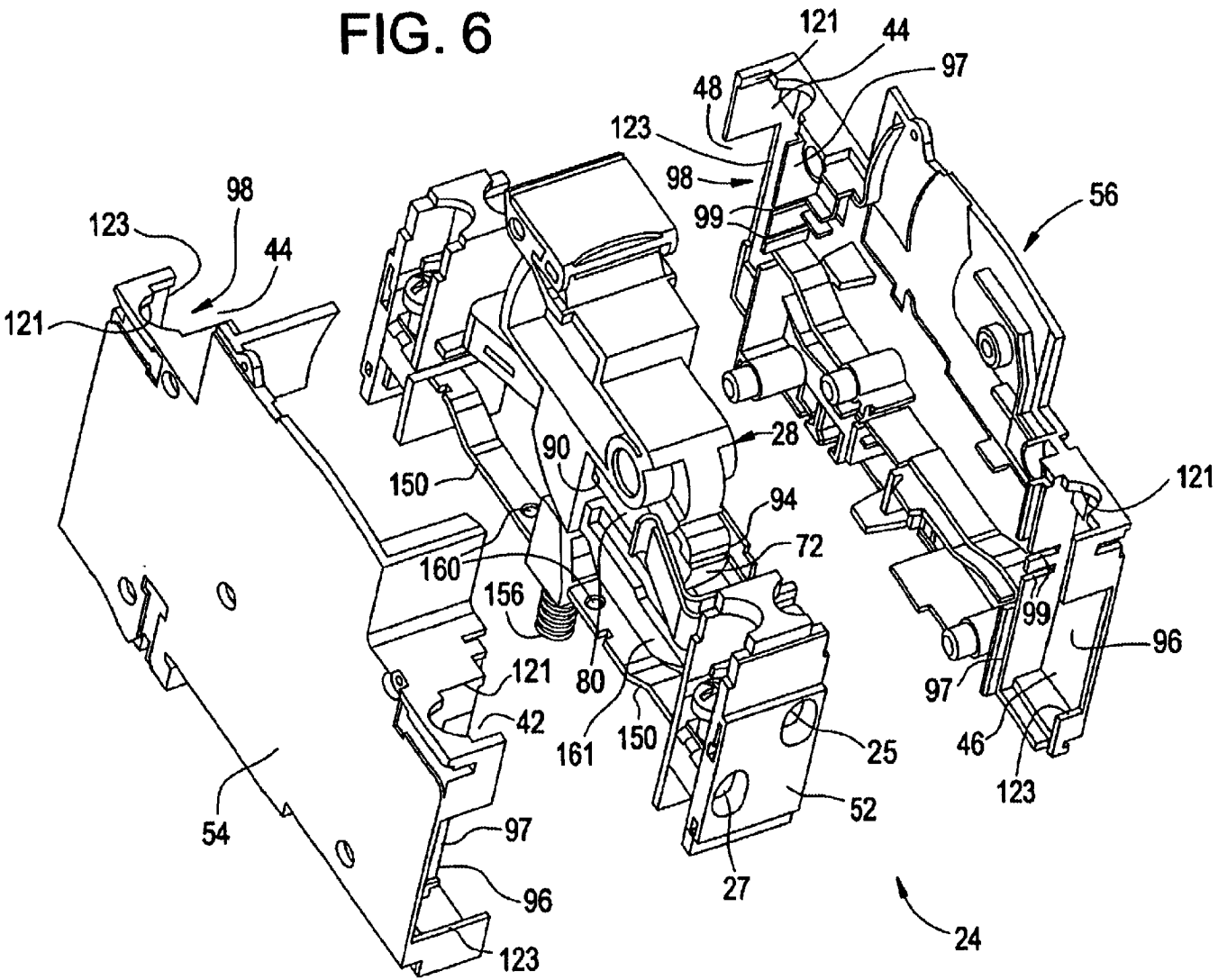
FIG. 6 is a partially exploded view of the fuse holder shown in FIG. 2.

Referring to FIG. 6, an exploded view of fuse holder 24 with two pole cage holders 52 is illustrated. Cover 56 and base 54 are separated to reveal the interaction of fuse carrier 28 with cage holder 52. Cover 56 and base 54 are configured to form a first cavity 96 and a second cavity 98. Cavities 96, 98 are disposed at opposite ends of region 29, and each cavity 96, 98 is configured to receive either cage holder 50 or cage holder 52. In this manner, the same cover 56 and base 54 can be used for different cage holders 50, 52. Two inside edges 97 depending from housing 26 and disposed in region 29 define cavities 96, 98. Each edge 97 has slots 99 formed therein to receive terminals 68, 70 and allow electrical communication between single pole terminal 25 and neutral connection terminal 27 within cage holder 52 disposed at either end of fuse holder 24.

Figure 7:
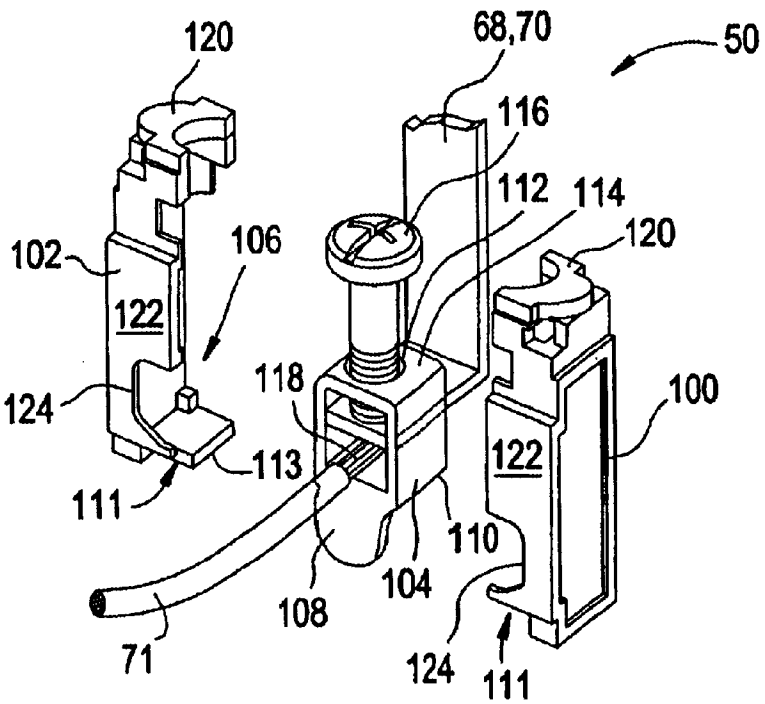
FIG. 7 is a perspective view of an exemplary cage holder used in the fuse holder shown in FIGS. 1 and 3.

Referring to FIG. 7, cage holder 50 for use with a single pole without a neutral connection is illustrated. Cage holder 50 comprises a first half section 100 and a complementary second half section 102. Both sections 100, 102 are configured to receivably retain a cage 104 within an interior portion 106 of cage holder 50. Cage 104 is stamped from an electrically conductive material, such as copper, aluminum, or the like. Cage 104 includes a flange 108 extending generally perpendicular from a bottom side 110 of cage 104. Flange 108 prevents rotation of cage 104 when cage 104 is disposed within interior portion 106 of cage holder 50. More specifically, flange 108 extends through a forward facing slot 111 formed in a bottom surface 113 of cage holder 50. In this way, bottom side 110 of cage 104 rests on bottom surface 113 of cage holder 50. Cage 104 further includes a threaded opening 112 at a top side 114 for threadably receiving a screw 116. An electrical wire (i.e., wire 71 in FIG. 3) is received in an enclosed area 118 defined by cage 104 and retained therein when screw 116 is tightened against terminals 68, 70 extending in cage 104 to retain wire 71 by clamping wire 71 between terminal 68, 70 and bottom side 110 of cage 104.

Referring to FIGS. 6 and 7, cage holder 50 includes a top surface 120 configured to fit within edges 121 defining apertures 42, 44. Top surface 120 includes an opening for access to screw 116 for operatively turning screw 116 with a tool, such as a screwdriver. Cage holder 50 further comprises a front face 122 configured to fill openings 46, 48, while providing a generally flush surface mount between housing 26 and front face 122. Front face 122 includes a cutout 124 aligned with enclosed area 118 of cage 104 to allow connection of wire 71 with cage 104.

Figure 8:
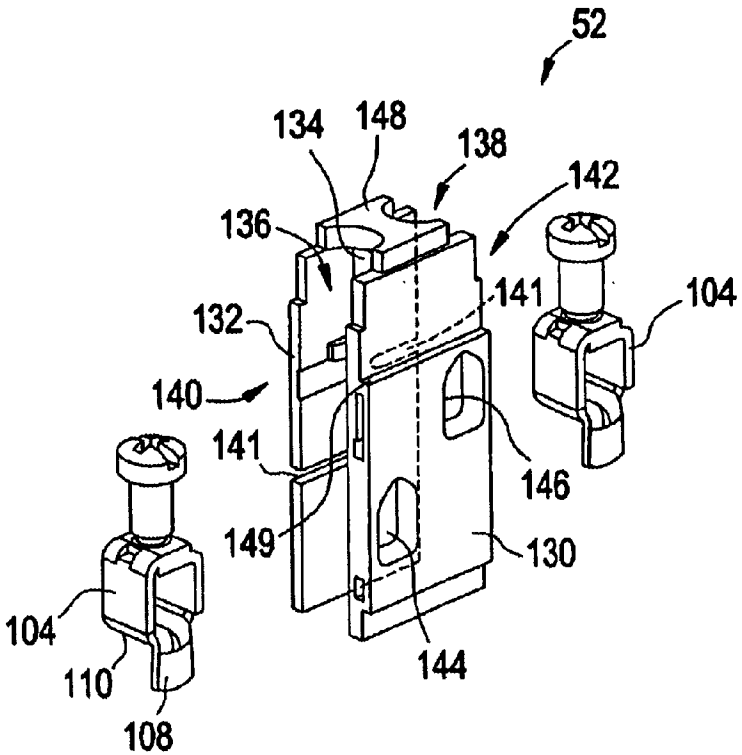
FIG. 8 is a perspective view of another exemplary cage holder used in the fuse holder shown in FIGS. 2 and 6.

Referring to FIG. 8, cage holder 52 for use with a single pole including a neutral connection is illustrated. Cage holder 52 has a front face 130, a rear face 132 and a dividing face 134 disposed intermediate faces 130, 132 and generally extending perpendicularly therebetween. Dividing face 134 and front and rear faces 130, 132 define a first cavity 136 and a second cavity 138 within cage holder 52. One cage 104 is received in cavity 136 for a neutral connection by disposing cage 104 in between front face 130 and rear face 132 from a first side 140 of cage holder 52. A slot 141 is disposed on rear face 132 and aligned with one cage 104 to provide access for a neutral strap terminal (not shown) to one cage 104. Another cage 104 is received between front face 130 and rear face 132 from a second side 142 of cage holder 52. Another slot 141 (shown in phantom) is disposed on rear face 132 and aligned with cage 104 in cavity 138 to provide access for terminals 68, 70. Front face 130 includes a cutout 144 aligned with one cage 104 received in first cavity 136 and a cutout 146 aligned with another cage 104 received in second cavity 138.

Referring to FIGS. 6 and 8, cage holder 52 further comprises a top surface 148 configured to fit within edges 121 defining apertures 42, 44 formed in housing 26. Top surface 148 is configured to divide each aperture 42, 44 to provide two openings in each aperture 42, 44 coinciding with cavities 136, 138 to allow access to screw 116 of each cage 104 disposed in each cavity 136, 138. Likewise, front face 130 is defined by a front face edge 149 configured to fit within edges 123 defining openings 46, 48. Front face edge 149 offers a generally flush surface mount between housing 26 and front face 130.

Figure 9:
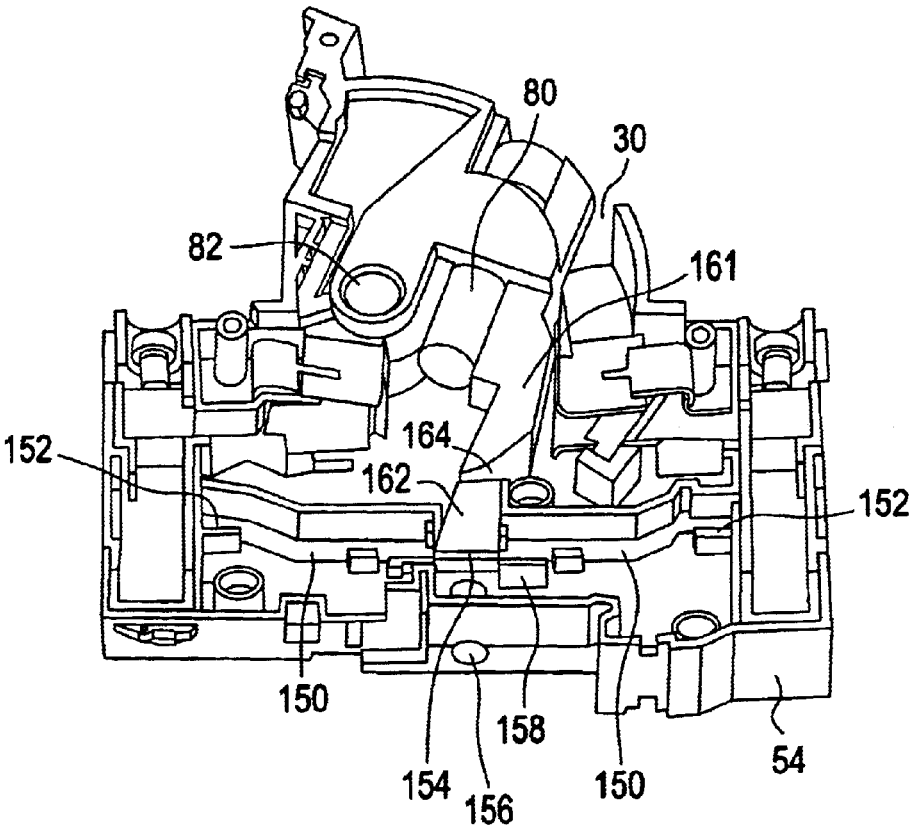
FIG. 9 is a perspective of a fuse holder shown in FIGS. 2 and 6 in an open position detailing a neutral connection.
Figure 11:
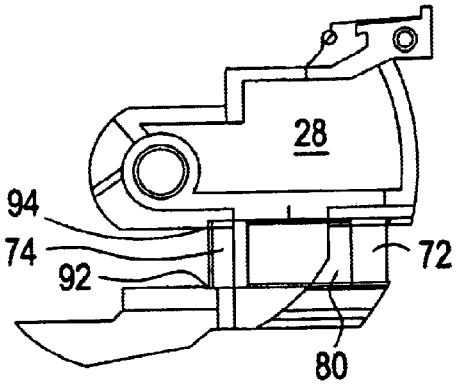
FIGS. 11–16 illustrate each fuse carrier type with a corresponding fuse listed in FIG. 10.
Figure 12:
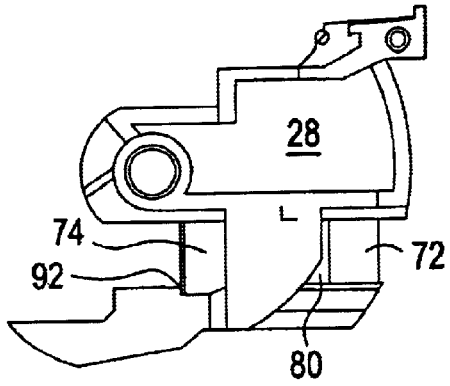
Figure 13:
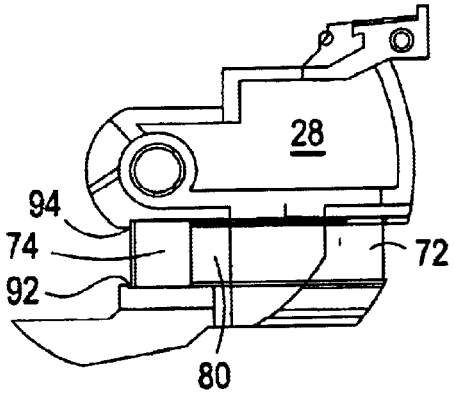
Figure 14:
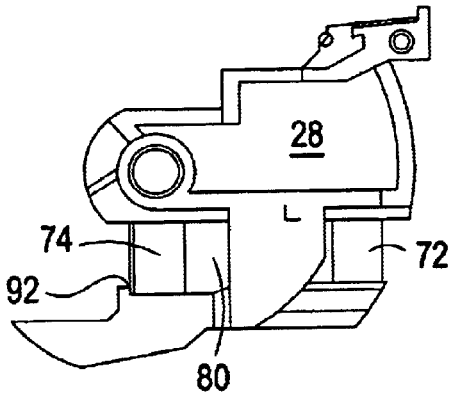
Figure 15:
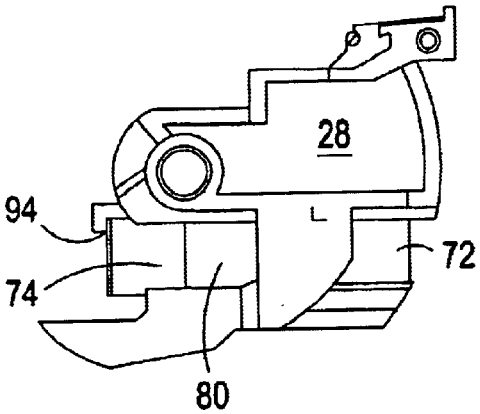
Figure 16:
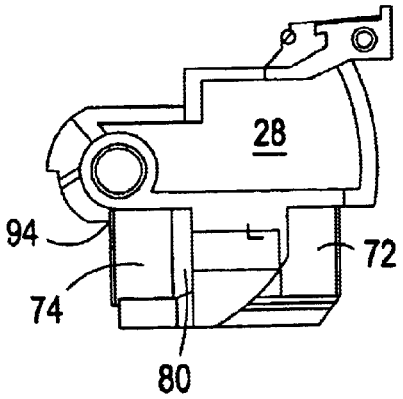

Referring to FIGS. 6 and 9, a description of fuse holder 24 having neutral connection terminal 27 follows. Neutral connection terminal 27 includes a pair of neutral straps 150 disposed between two pairs of raised ribs 152 configured in base 54. An angled block 154 is disposed intermediate straps 150 separating one pair of raised ribs 152 from the other pair of ribs 152. Block 154 is biased towards opening 30 by a spring 156 and is guided by ribs 152. One end of spring 156 depends from base 54 while another end of spring 156 depends from a bottom surface of block 154. Block 154 includes a conducting plate 158 positioned to provide electrical connection between neutral straps 150 when block 154 is moved towards opening 30. Each neutral strap 150 includes a protrusion 160 pointing downward towards conducting plate 158 to make the electrical connection between neutral straps 150 and plate 158.

FIG. 9 illustrates fuse holder 24 with block 154 in the open position, thus breaking the electrical connection between neutral straps 150. When fuse carrier 28 is pivoted about aperture 82 in a counterclockwise direction, an arm 161 depending from fuse carrier 28 contacts an angled surfacer 62 of angled block 154. Further counterclockwise pivoting of fuse carrier 28 forces the block 154 downward, thereby breaking the electrical connection between a top surface of plate 158 and protrusions 160. When fuse carrier 28 is fully opened as shown in FIG. 9, arm 161 contacts a top surface 164 of bock 154 biasing block 154 downward against the bias of spring 156. It will be appreciated that arm 161 is configured to break the neutral circuit before the circuit carrying fuse 80 is broken when opening fuse carrier 28 from a closed position.

To close fuse carrier 28 with fuse 80 inserted therein, fuse carrier 28 is pivoted clockwise about a pin (not shown) inserted in aperture 82. When fuse carrier 28 is pivoted in a clockwise direction, arm 161 is tapered to allow block 154 to move upward under action of spring 156 as arm 161 is pivoted away to the left limiting contact with block 154. Further clockwise pivoting of fuse carrier 28 allows block 154 to translate upward, thereby making the electrical connection between top surface of plate 158 and protrusions 160. When fuse carrier 28 is fully closed as shown in FIG. 6, arm 161 no longer contacts top surface 164 of bock 154 biasing block 154 downward against the bias of spring 156 and fuse 80 is electrically connected with contacts 64, 66.

Turning to FIG. 10, a table 200 illustrates six different fuse carrier types 204 that can be inserted within housing 26. A first column 202 lists a carrier type 204 (i.e., one through six). A second column 206 adjacent to first column 202 lists a fuse type 208 that is utilized in a carrier type 204. For example, if "Carrier Type 2" is selected from first column 202, a corresponding fuse type 208 in column 206 indicates that a NFC 210 and a BS 212 type fuse may be utilized in carrier type 2. "NFC" is a French standard for fuses and "BS" is a British standard for fuses. Table 200 shows a total of seven different fuse types 208 for use with six different fuse carriers 28. Each different fuse carrier 28 can be installed in an identical housing 26. A third column 214 lists the ampere ratings for fuses 80 that correspond with a selected fuse carrier type 204, and vice versa. Columns 216, 218, and 220 list fuse 80 dimensions corresponding to fuse length, fuse diameter, and fuse end cap terminal length, respectively, for a particular fuse 80 that can be utilized with a selected fuse carrier type 202. Table 200 is provided as an example and is not to be construed as exhaustive, as it will be appreciated that other fuse carriers are optionally configured to accept differently dimensioned fuses for use with the same housing 26.

Referring to FIGS. 11–16, a fuse carrier 28 representing each of the fuse carrier types 204 (i.e., 1–6) listed in table 200 are illustrated having fuse 80 of the corresponding fuse type 208 inserted therein. Each fuse carrier 28 in FIGS. 11–16 is configured to receive a corresponding fuse 80 and position fuse 80 in electrical communication with contacts 64 and 66 (FIG. 3) or 166 (FIG. 5) when fuse carrier 28 is inserted in housing 26 (FIGS. 3 and 5) and is pivoted about a pin disposed in aperture 82 to a closed position. Each fuse carrier 28 is configured to receive a particular fuse having specific dimensions. However, each fuse carrier 28 in FIGS. 11–16 is configured such that each carrier 28 may be inserted in a housing that is configured to be utilized with any one fuse carrier 28 in FIGS. 11–16. Since housing 26 has a single configuration adapted to accept each fuse carrier 28 in FIGS. 11–16, a separate base 54 and cover 56 are not necessary for each fuse type 208 having different dimensions utilized in fuse holder 24.

The fuse holder 24 provides the flexibility of achieving a fuse holder for different fuses having different dimensions utilizing the same base and cover, while only changing the fuse carriers that support the different fuses. By using the same base and cover for housing different fuse carriers supporting variably dimensioned fuses, costs associated with tooling and inventory are reduced. It will be appreciated that the present disclosure is not limited to single pole fuse holders and may be utilized with multiple pole fuse holders.

Figure 17:
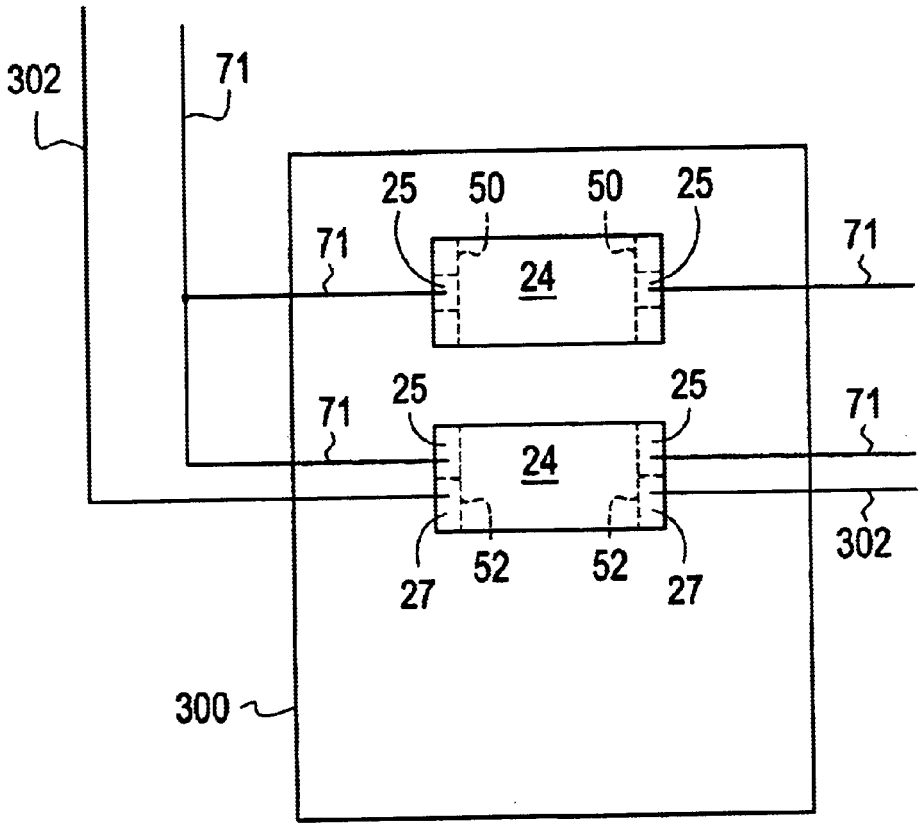
FIG. 17 is a schematic view of an electrical enclosure including a single pole fuse holder and a single pole fuse holder with a neutral connection.

Referring to FIG. 17, a schematic diagram illustrates a fuse system for fuse protection to a distribution circuit in an electrical enclosure 300. Electrical enclosure 300 optionally includes a panel board. Electrical enclosure 300 receives electrical power from electrical wire 71 that is electrically connected to terminal 25 within cage holder 50 (shown in phantom lines) at one end of each fuse holder 24 attached to enclosure 300. Another terminal 25 at an opposite end of each fuse holder 24 is connected to wire 71 that provides a path for electrical current to a protected circuit (not shown). The lower mounted fuse holder 24 shown in FIG. 17 includes a neutral line 302 received in neutral terminal 27 within cage holder 52 (shown in phantom) at one end of fuse holder 24. Neutral line 302 exits fuse holder 24 from another neutral terminal 27 disposed in cage holder 52 at an opposite end of fuse holder 24 and provides a neutral line connection for a protected circuit (not shown).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fuse holder comprising:

a fuse having a pair of fuse terminals;

a housing configured to accept any fuse carrier selected from a plurality of fuse carriers, said housing defining an enclosed region adapted to accept said fuse;

a pair of contacts within said housing at opposite ends of said enclosed region and configured to engage said fuse terminals; and a fuse carrier selected from said plurality of fuse carriers, each fuse carrier of said plurality of fuse carriers configured to support a different fuse size including at least one terminal, said fuse carrier configured to support said fuse and position said fuse terminals in said enclosed region in electrical engagement with said pair of contacts.

2. The fuse holder of claim 1 wherein said fuse carrier is pivotally mounted on said housing, said fuse carrier is movable between a closed position, in which said pair of contacts electrically engage said fuse terminals, and an open position, in which said fuse can be inserted into said fuse carrier.

3. The fuse holder of claim 1 wherein said housing comprises:

a base; and a cover secured to said base.

4. The fuse holder of claim 1 wherein said fuse carrier includes:

a fuse insertion region, said fuse insertion region is generally cylindrical having a diameter matched to said fuse terminals, said fuse insertion region having openings at either end configured to allow electrical communication between said pair of contacts and said fuse terminals.

5. The fuse holder of claim 4 wherein said fuse insertion region further includes:

an end stop formed on said fuse carrier and extending within said fuse insertion region to prevent further insertion of said fuse in said insertion region.

6. The fuse holder of claim 1 wherein said pair of contacts are configured as U-shaped clips having an interior surface defined by said U-shaped clip, said interior surface engages a diameter defined by said fuse terminals.

7. The fuse holder of claim 6 wherein said pair of contacts include entry chamfers formed on an edge of said contacts facing said fuse terminals.

8. The fuse holder of claim 7 wherein each contact of said pair of contacts includes a fuse contact spring biasing said interior surface against said diameter of said fuse terminals, said each contact is configured for electrical communication with a wire entering said housing.

9. The fuse holder of claim 1 wherein said pair of contacts comprise:

a U-shaped clip having an interior surface, said interior surface engages a diameter defined by said fuse terminals; and a C-shaped clip having an exterior surface, said exterior surface engages an end of said fuse terminals.

10. A fuse system for fuse protection to a distribution circuit; said fuse system comprising:

an electrical enclosure;

a circuit entering said electrical enclosure;

a fuse holder connected to said circuit, said fuse holder including a fuse having a pair of fuse terminals;

a housing configured to accept any fuse carrier selected from a plurality of fuse carriers, said housing defining an enclosed region adapted to accept said fuse;

a pair of contacts within said housing at opposite ends of said enclosed region and configured to engage said fuse terminals; and a fuse carrier selected from said plurality of fuse carriers, each fuse carrier of said plurality of fuse carriers configured to support a different fuse size including at least one of a different overall length of said fuse and a different maximum diameter of said fuse terminals, said fuse carrier configured to support said fuse and position said fuse terminals in said enclosed region in electrical engagement with said pair of contacts.

11. The fuse system of claim 1 wherein said fuse carrier is pivotally mounted on said housing, said fuse carrier is movable between a closed position, in which said pair of contacts electrically engage said fuse terminals, and an open position, in which said fuse can be inserted into said fuse carrier.

12. The fuse system of claim 11 wherein said housing comprises:

a base; and a cover.

13. The fuse system of claim 11 wherein said fuse carrier includes:

a fuse insertion region, said fuse insertion region is generally cylindrical having a diameter matched to said fuse terminals, said fuse insertion region having openings at either end configured to allow electrical communication between said pair of contacts and said fuse terminals.

14. The fuse system of claim 13 wherein said fuse insertion region further includes:

an end stop formed on said fuse carrier and extending within said fuse insertion region to prevent further insertion of said fuse in said insertion region.

15. The fuse system of claim 11 wherein said pair of contacts are configured as U-shaped clips having an interior portion defined by said U-shaped clip, said interior surface engages a diameter defined by said fuse terminals.

16. The fuse system of claim 15 wherein said pair of contacts include entry chamfers formed on an edge of said contacts facing said fuse terminals.

17. The fuse system of claim 16 wherein each contact of said pair of contacts include a fuse contact spring biasing said interior surface against said diameter of said fuse terminals, said each contact is configured for electrical communication with a wire entering said housing.

18. The fuse system of claim 11 wherein said pair of contacts comprise:

a U-shaped clip having an interior surface, said interior surface engages a diameter defined by said fuse terminals; and a C-shaped clip having an exterior surface, said exterior surface engages an end of said fuse terminals.

19. A method of assembling a fuse holder comprising a housing having a cavity therein for supporting a fuse carrier, said method comprising:

selecting a fuse carrier from a plurality of fuse carriers, each fuse carrier of said plurality of fuse carriers configured to support a different fuse size including at least one of a different overall length of a fuse and a different maximum diameter of a pair of fuse terminals, said selecting being based on a desired current rating for a fuse to be fitted within said housing;

configuring said fuse carrier to accept and position said fuse for engagement with contacts disposed within said housing;

configuring said cavity to accept said plurality of fuse carriers; and installing said selected fuse carrier in said housing.

* * * * *

UNITED STATES PATENT AND TRADEMARK OFFICE

CERTIFICATE OF CORRECTION

PATENT NO. : 6,794,979 B2
APPLICATION NO. : 10/063474
DATED : September 21, 2004
INVENTOR(S) : Madhu Sudan et al.

It is certified that error appears in the above-identified patent and that said Letters Patent is hereby corrected as shown below:

Title Page,
Item (56) References Cited, U.S. Patent Documents, insert --

| | | | |
|---|---|---|---|
| 5,241,289 | 8/1993 | Markowski, et al. | 335/201 |
| 4,966,561 | 10/1990 | Norden | 439/622 |
| 4,543,557 | 9/1985 | Schaefer | 337/196 |
| 5,616,054 | 4/1997 | Quinlan | 439/621 -- |

Drawings,
FIG. 5, delete "97" and insert therefor --95--.

Column 2,
Line 18, after "perspective", insert therefor --view--.
Line 35, after "has a", delete "single" and insert therefor --phase--.

Column 5,
Line 11, after "of", delete "bock" and insert therefor --block--.
Line 26, after "of", delete "bock" and insert therefor --block--.

Column 6,
Line 56, after "one", delete "terminal" and insert therefor --of a different overall length of said fuse and a different maximum diameter of said fuse terminals,--.

Column 8,
Line 25, before "defined", delete "portion" and insert therefor --surface--.

Signed and Sealed this

Eleventh Day of July, 2006

JON W. DUDAS
*Director of the United States Patent and Trademark Office*